United States Patent [19]

Witworth

[11] 4,134,788

[45] Jan. 16, 1979

[54] DRAINAGE BLADE HAVING A RAISED, SMOOTHLY ROUNDED BEARING SURFACE

[75] Inventor: Otis R. Witworth, Appleton, Wis.

[73] Assignee: Menasha Corporation, Neenah, Wis.

[21] Appl. No.: 909,597

[22] Filed: May 25, 1978

[51] Int. Cl.[2] ..... D21F 1/54

[52] U.S. Cl. ..... 162/352; 162/374

[58] Field of Search ..... 162/352, 374

[56] References Cited

U.S. PATENT DOCUMENTS 3,732,142 5/1973 Beacom et al. ..... 162/352 X

FOREIGN PATENT DOCUMENTS 2108489 9/1971 Fed. Rep. of Germany ..... 162/352

*Primary Examiner*—Richard V. Fisher

[57] ABSTRACT

A drainage blade for a paper making machine has an upper surface contour including a front land portion, a rear foiling portion inclined downwardly at an angle up to about 5° and bridging the two portions, a smoothly curved, elevated bearing surface which extends above both the land portion and the foiling portion of the blade. Between the bearing surface and the leading edge of the blade, the land portion slopes upwardly at a small angle which may be about ½° to about 1°. The bearing surface is formed by a cylindrical insert which is rotated when the insert wears close to the level of the blade surface.

7 Claims, 5 Drawing Figures

DRAINAGE BLADE HAVING A RAISED, SMOOTHLY ROUNDED BEARING SURFACE

BACKGROUND OF THE INVENTION

Paper is made on a Fourdrinier machine in which a slurry, or stock, comprising paper fibers, water, and optional additives for the paper is fed from a head box to a moving wire. The fibers are caught on the surface of the wire and become a paper web and the water drains through the wire and is discharged from the machine. When the paper web is dry enough to be self-supporting it is removed from the wire and carried through further processing stages in the machine and finally is dried and rolled up. One of the controlling factors governing the speed at which the machine is run is the length of time required to cause the paper to become sufficiently dry so as to be self-supporting. Paper is sold in a highly competitive market and the savings in manufacturing costs resulting from a small increase in machine speed can be a substantial competitive advantage. Accordingly, it is of great importance to speed up the removal of water from the paper web.

At the point where the stock is deposited on the wire from the head box, the wire is supported by a series of blades or foils which extend across the machine, with spaces between the blades to permit the water to pass therethrough. The wire subsequently passes across a suction box where additional water is removed by suction. The blades which are positioned underneath the moving wire close to the head box are generally of a type shown in Wrist U.S. Pat. No. 2,928,465. These blades are characterized by having a horizontal upper surface at the leading edge of the blade, this leading surface sometimes being called the land portion, followed by a trailing portion, sometimes called the foiling surface, which diverges from the horizontal an an angle up to about 5°. It was found that this configuration for a foil caused water to be drawn through the wire more rapidly as a consequence of suction generated between the wire and the foiling portion. Such a blade removes water portion. the web or wire in two ways: The nose, or leading edge of the foil, bears against the wire and scrapes water from the lower surface of the wire; and the trailing portion causes a partial vacuum to pull water from the slurry side of paper fibers on the upper sides of the wire to the lower surface of the wire.

Since the first use of blades of the type shown by Wrist there have been many efforts to improve them. Foils have been produced with adjustable angles between the land and the trailing portion in an effort to improve performance. Because these blades are subject to wear they have been made easily removable and easily replaceable. Extra hard or wear-resistant materials have been employed in the manufacture of blades and wear-resistant coatings have been placed on the blade surfaces. Adjustable supports for such blades are shown, for example, in Dunlap U.S. Pat. No. 3,027,940. A wear-resistant coating or plate for the land portion of a blade is shown for example in Duncan U.S. Pat. No. 3,351,524. A wear-resistant insert fitted into a groove in the upper surface of the land and coplanar with the land surface is shown for example in Buchanan U.S. Pat. No. 3,446,702, and in Beacom U.S. Pat. No. 3,732,142. A wear-resistant insert in the trailing portion of the blade adjacent its intersection with the land is shown for example in Kienzl U.S. Pat. No. 3,738,911, and a wear-resistant tip is shown in Charbonneau U.S. Pat. No. 3,778,342. In addition, a wide variety of mounting means have been employed for quick change of blades. Thus, dovetails, as shown in Roecker U.S. Pat. Nos. 3,377,236, T-bars as shown in White 3,337,394, and other mounting means are employed.

In spite of all these changes in blade structure, there has not yet been much successful change in the contour of the upper surface of blades, and most or all blades heretofore in use have retained the contour of a horizontal land surface followed by a trailing foiling surface at a downward angle of 5° or less. For example, the blade of Buchanan U.S. Pat. Nos. 3,446,702 employs the same contour as that of Wrist 2,928,465 with the apparent exception that the angle between the plane of the land portion and the foiling portion is accentuated, particularly as the blade is worn by use.

GENERAL NATURE OF THE INVENTION

According to the present invention a new and improved blade for a Fourdrinier machine is provided with a new upper surface contour. Where prior blades generally have an angular intersection between a horizontal front or land surface and a trailing or foiling surface, the blades of the present invention have a raised curved bearing surface and the front edge or nose of the blade is pointed upwardly at an angle of about ½° to about 1° or so. The nose of the blade thus maintains a skimming contact with the under surface of the wire, removing all except a thin film of water from the bottom of the wire which then curves smoothly around the curved intersection and extends in substantially a catenary curve to the next blade. Immediately back of the curved bearing surface of the blade the foiling angle of up to about 5° is accentuated with resultant improvement in water removal.

The curved bearing surface of the blade supports and receives most of the weight and abrasion of the moving wire and a hard, wear resistant surface is provided at this point. To achieve this purpose a rounded wear resistant insert is employed, this insert preferably being cylindricalin shape and optionally made up of a plurality of cylindrical in segments positioned end-to-end in a groove positioned at and overlapping the line of junction between the land portion and the foil portion of the blade.

The radius of curvature of this insert preferably is in the order of ⅛ to ¼ inch, such as the curvature of a ¼ to ½ inch diameter cylindrical member. Such a curved surface positioned at and overlapping the intersection of land and foiling surfaces is raised above said surfaces by about 0.005 inch. If it is excessively high above the adjacent land surface, fines and other solid particles may collect in front of the insert or curve. If it is too near the plane of the land portion it decreases the water removing performance of the blade. For a blade with ⅛ inch radius of curvature of the raised portion, such blade to be used for a variety of papers including fine paper, a surface raised to 0.003 to 0.008 inch is now preferred.

The front or land portion of the blade points upwardly from the base of the raised bearing surface toward a raised nose, assuring a skimming or scraping contact between nose and machine wire, thus producing optimum water removal as the blade first meets the moving wire. The upward angle in the land surface of a new blade is about ½ to 1 degree. As the blade is used on a machine this upward tilt can be worn to its desired angle and contour provided the angle when new is sufficient to achieve the proper original skimming contact. If the upward tilt is significantly less than about ½ degree the wire and blade do not meet to remove water sufficiently; if the upward tilt is excessive, i.e., greater than about 1 degree, longer break-in wear is required but the blade ultimately breaks in to the desired configuration.

When a Fourdrinier machine is in use and operation, the wire moves from each bearing surface of a blade to the next such surface in a sequence of catenaries. Although the wire touches the blade surface at other points, most of the weight and and accordingly most of the abrasion is at these bearing surfaces. The bearing surfaces are, accordingly, smoothly rounded to minimize wear and damage to the wire. They are also highly abrasion resistant so as to last many months between replacements. According to the best mode of construction and operation of the invention as now understood, a cylindrical abrasion resistant insert properly positioned to overlap the juncture between land and foiling portion is mounted within a recess in the blade.

With the preferred embodiment of the invention, i.e. a cylindrical abrasion resistant insert, it is not necessary to replace the entire blade nor even replace the insert when the curved bearing surface becomes worn. Instead, the insert is rotated to bring to the top a fresh, unworn bearing surface. In this way, the expense of replacement is reduced and, perhaps even more importantly, rotation is much faster than replacement and machine down time is reduced.

The invention is illustrated in the drawings, in which.

DETAILED DESCRIPTION OF THE INVENTION

Figure 1:
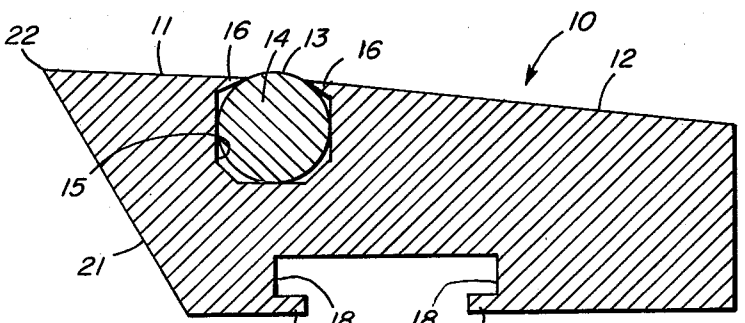
FIG. 1 is an end cross-section of a blade according to one embodiment of the invention.

In FIG. 1 is shown a foil blade generally designated 10 which usually is a body of extruded plastic or the like. The upper surface of the blade includes a front or land portion 11 and a rear or foiling portion 12, inclined downwardly. Overlapping the joint between the land 11 and the rear portion 12 is a smoothly rounded bearing surface 13 formed by a cylindrical insert 14 mounted in a groove 15. At the upper surface of the groove 15 are two lips 16 one located in the forward or land surface 11 and one located in the foiling portion 12 and adapted to grip the insert 14. At the base of the blade 10 is mounting means such as a T-bar comprising a flat groove 18 extending the length of the blade and having lips 19 on either side thereof. A T-bar mounting of this type is one conventional mounting means employed for mounting a blade removably on a fixed support member and is disclosed, for example, in U.S. Pat. No. 3,732,142.

Figure 2:
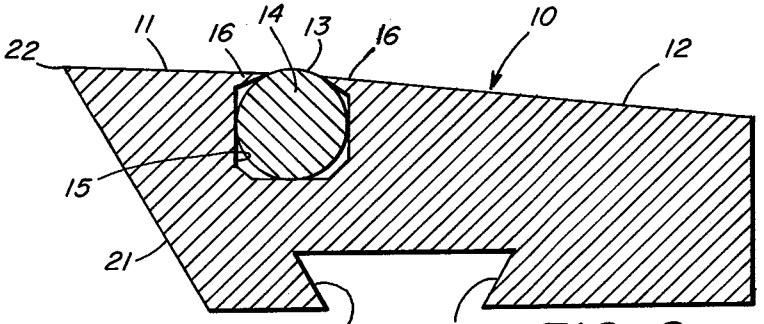
FIG. 2 is an end cross-section of a blade according to another embodiment of the invention, wherein different mounting means is employed.

In FIG. 2 is shown a similar blade generally designated 10 having a forward or land portion 11, a foiling portion 12, a bearing surface 13 formed by an insert 14 in groove 15 as in the blade of FIG. 1. In the blade of FIG. 2 there is a dovetail groove 20 extending the length of the blade. A dovetail groove of this type is another conventional mounting means used for easy removal of the blade from a fixed mounting support on a Fourdrinier machine, as is disclosed for example in U.S. Pat. No. 3,377,236.

The forward or land portion 11 of the blades shown in FIGS. 1 and 2 meets a front wall 21 of the blade at an angle which generally is somewhat sharper than a 90° angle. The leading edge 22 or nose 22 of blade 10 is adapted to skim the lower surface of the moving wire of a Fourdrinier machine to skim water off the undersurface thereof. The land 11 drops away from the nose at a very slight angle such as an angle of about ½° to 1° from the horizontal, with the result that the portion of the land 11 adjacent bearing surface 13 is slightly lower than the leading edge of the land.

The nose 22 of the blade is raised at least enough to assure contact between the nose 22 and the machine wire. When contact between the nose of a new blade and the wire is insufficient, the blade does not properly skim water off the wire. When the contact is mildly excessive, the moving wire rapidly wears the blade to a skimming condition, automatically adjusting for factors relating to machine speed, type of paper being made, moisture content of the paper as it reaches the blade location, etc. Accordingly, the tolerance is fairly rigid for a minimum angle of at least about ½° slope of the land portion and is significantly less rigid for a maximum angle of about 1° or so.

Figure 3:
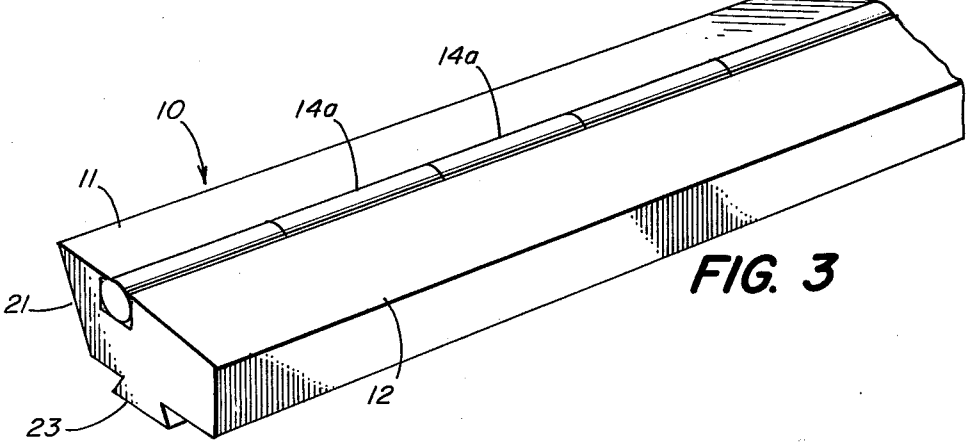
FIG. 3 is a perspective view of one embodiment of the invention employing still a different mounting means.
Figure 4:
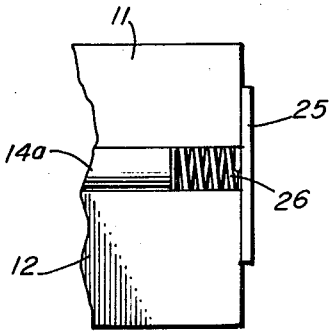
FIG. 4 is a segmented view of the articles in any of FIGS. 1, 2, and 3.

In FIG. 3 is shown a view of a modified blade 10 having a land portion 11, a foiling portion 12, a front wall 21, and a dovetail 23 for mounting the blade on a paper making machine. In this blade a plurality of cylindrical segments **14*a* are positioned in the groove 15 (not identified in this Figure) in end-to-end position to extend from one end of the blade to the other. As shown in FIG. 4 these segments 14*a* positioned in the groove between land portion 11 and foiling portion 12 are held in place by an end plate 25 and a spring 26 which bears against the end of the adjacent segment 14*a* of the insert 14. When the insert 14 becomes worn so that its top level begins to approach the level of land 11 and foiling portion 12, the insert can be rotated to bring a fresh bearing surface into position. The insert 14 is most easily rotated by removing end plate 25 to loosen spring 26 whereupon the insert segments 14*a*** are relatively easily rotatable.

Figure 5:
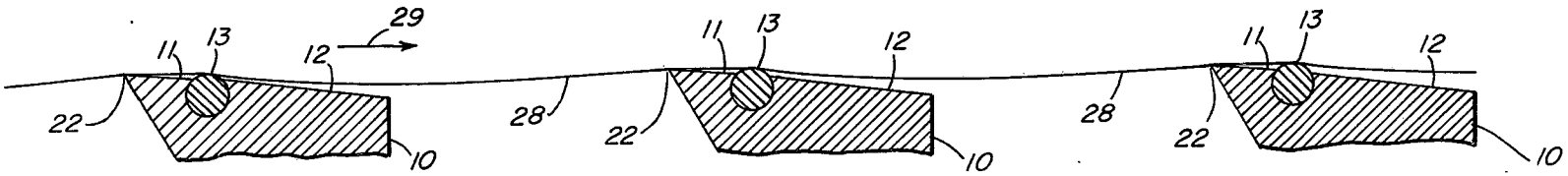
FIG. 5 is a diagrammatic view of blades according to this invention supporting a paper machine wire.

In FIG. 5 is shown diagrammatically a series of blades 10 positioned on a fourdrinier machine with a plurality of bearing surfaces 13. The wire 28 is supported by each bearing surface 13 and the nose 22 or leading edge of each blade 10 skims against the under surface of wire 28. The wire 28 is moving in the direction indicated by arrow 29 when the machine is in operation.

The contact between wire 28 and the bearing surfaces 13 is a supporting contact and is in fact the principle supporrting contact for wire 28 at this area of the machine. The wire extends between adjacent support points or bearing surfaces in essentially a catenary curve the shape of which depends on the machine speed, the type of paper being produced and other similar factors. The contact between wire 28 and nose 22 of each blade unlike the contact at the bearing surfaces is essentially a skimming contact which supports little if any weight of the wire and which serves to skim water off the under surface of the blade. It has been found that optimum removal of water from the paper on wire 28 is achieved when any contact between the wire and land portion 11 of the blade and contact between the wire and foiling portion 12 of the blade is essentially a non-supporting contact. In fact, wire 28 appears to ride an extremely small distance above foiling portion 12 and it is believed that vacuum forms therebetween and that this vacuum is helpful in drawing extra quantities of water to the bottom surface of the wire 28 so that this water can be skimmed from such surface by the next succeeding nose 22.

In the presently preferred embodiment of the invention the bearing surface 13 is formed by a cylindrical insert 14 in the upper portion of the blade. Blades used in paper making machines are generally quite long, usually being between about 10 or 12 feet for fairly short blades up to lengths of 20 or more feet for longer blades. Ceramic blades or other blades formed of wear resistant or abrasion resistant material are very expensive and extremely difficult to manufacture, and in particular, are difficult to manufacture to tolerances required for paper making equipment. It has become the custom, accordingly, to employ inserts such as, for example, the inserts of the Buchanan patent and the Beacom patent identified above. It is the preferred form of the present invention to achieve the elevated, curved bearing surface 13 by means of an added member or element such as insert 14. In this manner, bearing surface 13 receives most of the wear when the machine is in operation, and bearing surface 13 is made of a wear resistant material such as aluminum oxide, although other materials such as carbide, silicon carbide and other ceramic materials may be used, or rods or like members having a coating of a wear resistant material may be employed. Such coated rods may have the advantage of being less brittle and of being manufactured in longer lengths or longer segments. The smooth, cylindrical surface of insert 14 permits it to be rotated after a number of months' wear so as to bring a fresh bearing surface into supporting position to support the machine wire.

The blade of the present invention is easily installed either on machines already having replaceable blades or on machines with permanently mounted blades. Many machines now in use have familiar T-bar mountings such as for blades as shown in FIG. 1, or have dovetail mountings as for blades of the type shown in FIGS. 2 or 3. With such blade mounting the old blade is removed and the new blade of the present invention is inserted in its place. Care should be taken to be sure the mounting is truly horizontal so as to achieve maximum benefit from the new blade contour. With permanent mounting, the new blade with a base shaped like the existing base is permanently mounted in the same manner as the old: often upon changing to the blade of the present invention a quick-replacement mounting should be installed as part of the change of blade. In most cases it is to be expected that the new blade of the present invention with a rotatable insert will last for several years of heavy duty operation.

I claim:

1. A drainage blade for a Fourdrinier machine adapted to support the wire of such machine and to facilitate removal of water from a paper web on said wire, the upper surface of said blade having a front land portion in a nearly horizontal position and a rear foiling portion declining from the horizontal at an angle of up to about 5°, a bearing surface at and overlapping the line of junction between the land portion and the foiling portion, said bearing surface being smoothly rounded and the top position of the bearing surface being raised above the plane of the land surface and above the plane of the foiling surface by a height between about 0.003 inch and about 0.008 inch, said land portion being inclined upwardly to the leading edge of the blade from its junction with the bearing surface by an angle of at least ½ degree.

2. The blade of claim 1, in which the bearing surface is formed by a cylindrical insert of a wear resistant material located largely within a groove at the junction between the land surface and the foiling surface and extending above the planes of said land surface and said foiling surface.

3. The blade of claim 2, wherein said cylindrical insert comprises a plurality of cylindrical elements secured in endabutting relationship.

4. The blade of claim 1, in which a renewable bearing surface comprises a cylindrical insert of a wear resistant material rotatably positioned largely within a groove at the junction between the land surface and the foiling surface and extending above the planes of said surfaces, and having releasable holding means to secure said cylindrical insert in a fixed position within said groove, whereby a fresh bearing surface can be brought into position by releasing said holding means and rotating said cylindrical insert.

5. The blade of claim 4, wherein said cylindrical insert comprises a plurality of cylindrical elements secured in end abutting relationship.

6. The blade of claim 2, wherein said insert is aluminum oxide.

7. The blade of claim 4, wherein said insert is aluminum oxide.

* * * * *

UNITED STATES PATENT AND TRADEMARK OFFICE

CERTIFICATE OF CORRECTION

PATENT NO. : 4,134,788

DATED : January 16, 1979

INVENTOR(S) : Otis R. Witworth

It is certified that error appears in the above-identified patent and that said Letters Patent are hereby corrected as shown below:

Column 1, line 42, change "portion" to read: -- from---.

Column 2, line 42, after "cylindrical"delete "in".

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*